US011640125B2

(12) United States Patent
Mochizuki

(10) Patent No.: US 11,640,125 B2
(45) Date of Patent: May 2, 2023

(54) IMAGE FORMING APPARATUS FOR REGULATING REMOVAL OF DEVELOPER STORAGE PORTION, REGULATION RELEASE METHOD

(71) Applicant: KYOCERA Document Solutions Inc., Osaka (JP)

(72) Inventor: Masayuki Mochizuki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/452,846

(22) Filed: Oct. 29, 2021

(65) Prior Publication Data

US 2022/0137532 A1 May 5, 2022

(30) Foreign Application Priority Data

Oct. 30, 2020 (JP) ..... JP2020-182422

(51) Int. Cl.
*G03G 15/08* (2006.01)

(52) U.S. Cl.
CPC ..... *G03G 15/0868* (2013.01); *G03G 15/0872* (2013.01)

(58) Field of Classification Search
CPC ..... G03G 15/0872; G03G 15/0868
See application file for complete search history.

(56) References Cited

U.S. PATENT DOCUMENTS

2016/0378019 A1* 12/2016 Asaka ..... G03G 15/0891 399/27
2017/0315501 A1* 11/2017 Mochizuki ..... G03G 21/1676

FOREIGN PATENT DOCUMENTS

JP H11109752 A 4/1999

* cited by examiner

*Primary Examiner* — Victor Verbitsky
(74) *Attorney, Agent, or Firm* — Alleman Hall Creasman & Tuttle LLP

(57) ABSTRACT

An image forming apparatus includes an image forming portion, a first release processing portion, and a second release processing portion. The image forming portion includes a storage portion storing developer and forms an image by using the developer stored in the storage portion. The first release processing portion releases regulation on removal of a developer storage portion when a storage amount of the developer stored in the storage portion is equal to or smaller than a second threshold smaller than a first threshold. The second release processing portion releases the regulation on the removal of the developer storage portion based on the remaining amount of the developer that is acquired when the storage amount of the developer stored in the storage portion is larger than the second threshold.

3 Claims, 9 Drawing Sheets

IMAGE FORMING APPARATUS FOR REGULATING REMOVAL OF DEVELOPER STORAGE PORTION, REGULATION RELEASE METHOD

INCORPORATION BY REFERENCE

This application is based upon and claims the benefit of priority from the corresponding Japanese Patent Application No. 2020-182422 filed on Oct. 30, 2020, the entire contents of which are incorporated herein by reference.

BACKGROUND

The present disclosure relates to an image forming apparatus and a regulation release method that is executed in an image forming apparatus.

There is known an image forming apparatus that is configured to regulate removal of a developer storage portion, such as a toner container, from an attachment portion to which the developer storage portion is attached.

For example, in the image forming apparatus, in a case where an amount of developer stored in a developing portion that develops an electrostatic latent image by using the developer is equal to or smaller than a predetermined first threshold, the developer is supplied to the developing portion from the developer storage portion attached to the attachment portion. In addition, in a case where the amount of developer stored in the developing portion is equal to or smaller than a second threshold that is smaller than the first threshold, a regulation on the removal of the developer storage portion is released. With this configuration, as compared with a configuration where the developer storage portion can be replaced at an arbitrary timing, it is possible to reduce the remaining amount of developer in the developer storage portion at the time of a replacement of the developer storage portion.

SUMMARY

An image forming apparatus according to an aspect of the present disclosure includes an attachment portion, a regulation portion, an image forming portion, a supply processing portion, a first release processing portion, an acquisition processing portion, and a second release processing portion. A developer storage portion storing developer is attached to an attachment portion. The regulation portion regulates removal of the developer storage portion attached to the attachment portion from the attachment portion. The image forming portion includes a storage portion storing the developer and forms an image by using the developer stored in the storage portion. The supply processing portion supplies the developer from the developer storage portion attached to the attachment portion to the storage portion when a storage amount of the developer stored in the storage portion is equal to or smaller than a predetermined first threshold. The first release processing portion releases regulation on the removal of the developer storage portion imposed by the regulation portion when the storage amount of the developer stored in the storage portion is equal to or smaller than a second threshold that is smaller than the first threshold. The acquisition processing portion acquires a remaining amount of the developer in the developer storage portion attached to the attachment portion when the storage amount of the developer stored in the storage portion is larger than the second threshold. The second release processing portion releases the regulation on the removal of the developer storage portion imposed by the regulation portion, based on the remaining amount of the developer acquired by the acquisition processing portion.

A regulation release method according to another aspect of the present disclosure is executed in an image forming apparatus that includes an attachment portion to which a developer storage portion storing developer is attached, a regulation portion configured to regulate removal of the developer storage portion attached to the attachment portion from the attachment portion, and an image forming portion including a storage portion storing the developer and configured to form an image by using the developer stored in the storage portion, the regulation release method including a supply step, a first release step, an acquisition step, and a second release step. In the supply step, the developer is supplied from the developer storage portion attached to the attachment portion to the storage portion when a storage amount of the developer stored in the storage portion is equal to or smaller than a predetermined first threshold. In the first release step, regulation on the removal of the developer storage portion imposed by the regulation portion is released when the storage amount of the developer stored in the storage portion is equal to or smaller than a second threshold that is smaller than the first threshold. In the acquisition step, a remaining amount of the developer in the developer storage portion attached to the attachment portion is acquired when the storage amount of the developer stored in the storage portion is larger than the second threshold. In the second release step, the regulation on the removal of the developer storage portion imposed by the regulation portion is released based on the remaining amount of the developer acquired in the acquisition step.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 100]

First, a configuration of an image forming apparatus 100 according to an embodiment of the present disclosure is described with reference to FIG. 1 and FIG. 2. FIG. 2 is a perspective diagram showing an outer appearance of the image forming apparatus 100. It is noted that FIG. 2 shows the image forming apparatus 100 in a state where an ADF 1 is removed therefrom.

For convenience of the explanation, the vertical direction in an installation state where the image forming apparatus 100 is installed in a usable manner (the state shown in FIG. 2) is defined as an up-down direction D1. In addition, a front-rear direction D2 is defined on the supposition that a front right surface of the image forming apparatus 100 shown in FIG. 2 is a front (front surface). In addition, a left-right direction D3 is defined with reference to the front of the image forming apparatus 100 in the installation state.

The image forming apparatus 100 is a multifunction peripheral having a plurality of functions such as a scan function to read an image of a document sheet, a print function to form an image based on image data, a facsimile function, and a copy function. It is noted that the image forming apparatus 100 may be a printer, a facsimile apparatus, or a copier.

Figure 1:
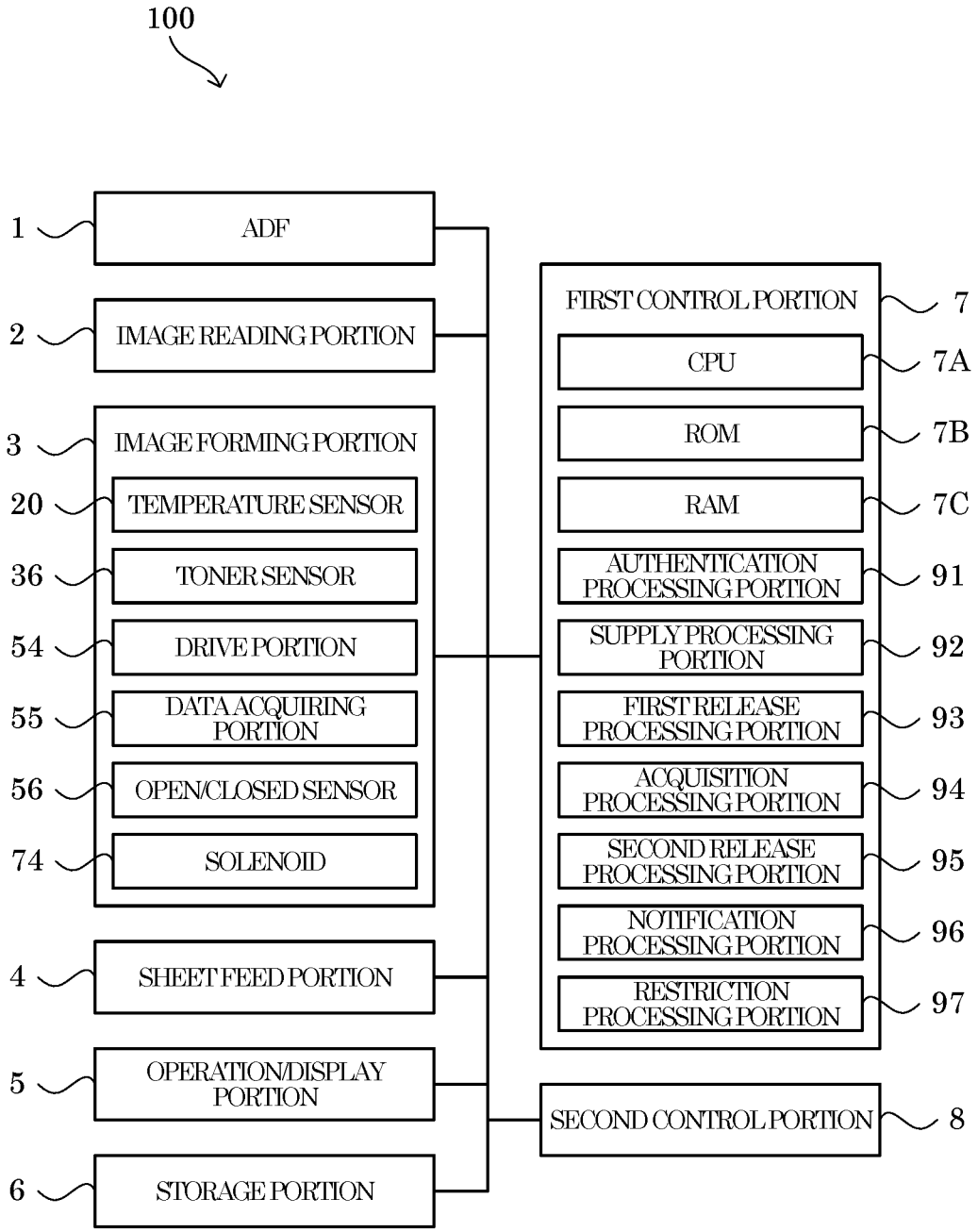
FIG. 1 is a block diagram showing a system configuration of an image forming apparatus according to an embodiment of the present disclosure.
Figure 2:
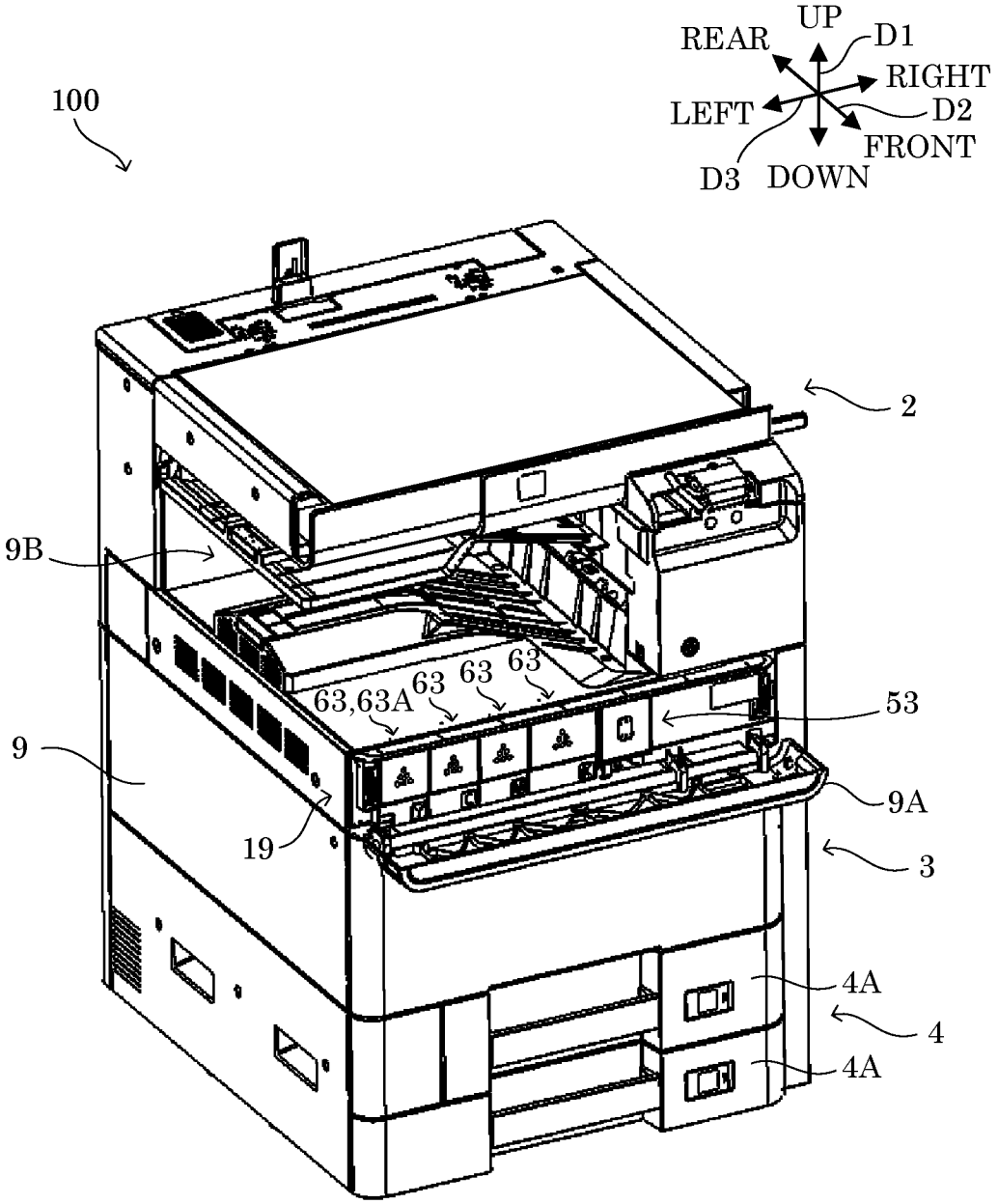
FIG. 2 is a diagram showing an outer appearance of the image forming apparatus according to the embodiment of the present disclosure.

As shown in FIG. 1 and FIG. 2, the image forming apparatus 100 includes the ADF (Auto Document Feeder) 1, an image reading portion 2, an image forming portion 3, a sheet feed portion 4, an operation/display portion 5, a storage portion 6, a first control portion 7, a second control portion 8, and a housing 9.

The ADF 1 conveys the document sheet that is targeted to be read by the scan function. For example, the ADF 1 includes a document sheet setting portion, a plurality of conveyance rollers, a document sheet pressing member, and a sheet ejecting portion.

The image reading portion 2 realizes the scan function. For example, the image reading portion 2 includes a document sheet table, a light source, a plurality of mirrors, an optical lens, and a CCD (Charge Coupled Device).

The image forming portion 3 realizes the print function. Specifically, the image forming portion 3 forms an image by an electrophotographic method. For example, the image forming portion 3 forms an image by using developer that includes toner (an example of developer of the present disclosure) and carrier.

The sheet feed portion 4 feeds a sheet to the image forming portion 3. For example, the sheet feed portion 4 includes sheet feed cassettes 4A (see FIG. 2), a sheet conveyance path, and a plurality of conveyance rollers.

The operation/display portion 5 is a user interface of the image forming apparatus 100. For example, the operation/display portion 5 includes a display portion and an operation portion. The display portion is, for example, a liquid crystal display and displays various types of information in response to control instructions from the first control portion 7. The operation portion is composed of, for example, operation keys or a touch panel through which various types of information are input to the first control portion 7 in response to user operations.

The storage portion 6 is a non-volatile storage device. For example, the storage portion 6 is a storage device such as: a non-volatile memory such as a flash memory or an EEPROM; an SSD (Solid State Drive); or an HDD (Hard Disk Drive).

The storage portion 6 stores user information regarding users who can log in the image forming apparatus 100. The user information includes authentication information that is used to authenticate the users. For example, the authentication information is composed of a user name and a password.

The first control portion 7 comprehensively controls the image forming apparatus 100. As shown in FIG. 1, the first control portion 7 includes a CPU 7A, a ROM 7B, and a RAM 7C. The CPU 7A is a processor that executes various types of calculation processes. The ROM 7B is a nonvolatile storage device in which various types of information such as control programs for causing the CPU 7A to execute various processes are preliminarily stored. The RAM 7C is a volatile storage device that is used as a temporary storage memory (working area) for the various types of processes executed by the CPU 7A. In the first control portion 7, the CPU 7A executes the various types of control programs that are preliminarily stored in the ROM 7B. This allows the image forming apparatus 100 to be controlled comprehensively by the first control portion 7.

The second control portion 8 controls the image forming portion 3. For example, the second control portion 8 is composed of electronic circuits such as integrated circuits (ASIC, DSP).

The housing 9 stores some components of the image forming apparatus 100. As shown in FIG. 2, the housing 9 is formed approximately in a square pole shape. The sheet feed cassettes 4A are provided at a lower portion of the housing 9 so as to be inserted and drawn in the front-rear direction D2. A front cover 9A is provided on the front surface of the housing 9. A lower end part of the front cover 9A is supported in such a way as to be pivotable around a rotary shaft that is elongated in the left-right direction D3, and the front cover 9A is opened as its upper part pivots forward. On the housing 9, there is provided a sheet ejecting space 9B that is opened to the left and the front. A sheet with an image formed thereon by the image forming portion 3 is ejected into the sheet ejecting space 9B.

[Configuration of Image Forming Portion 3]

Figure 3:
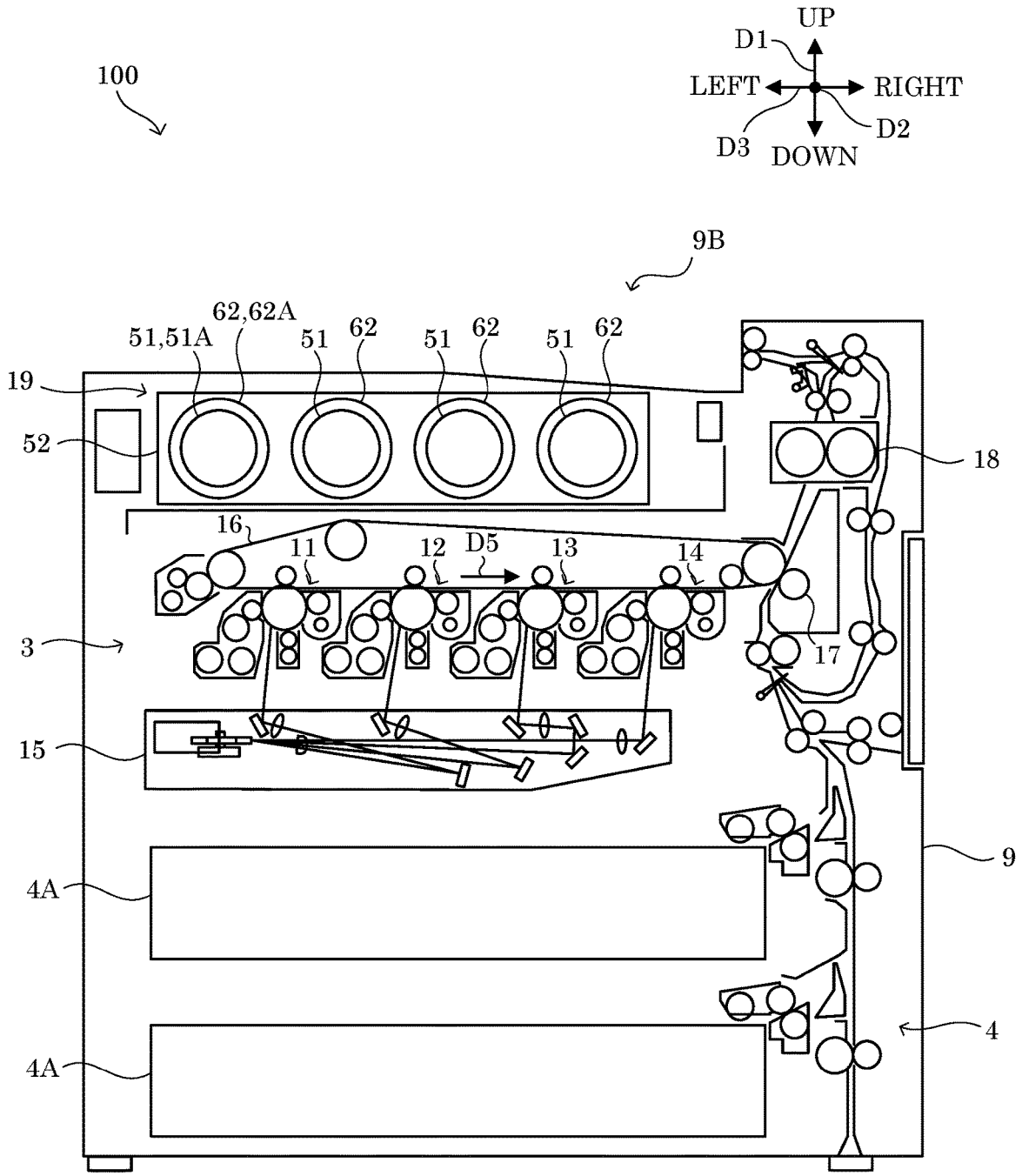
FIG. 3 is a diagram showing an internal configuration of the image forming apparatus according to the embodiment of the present disclosure.
Figure 4:
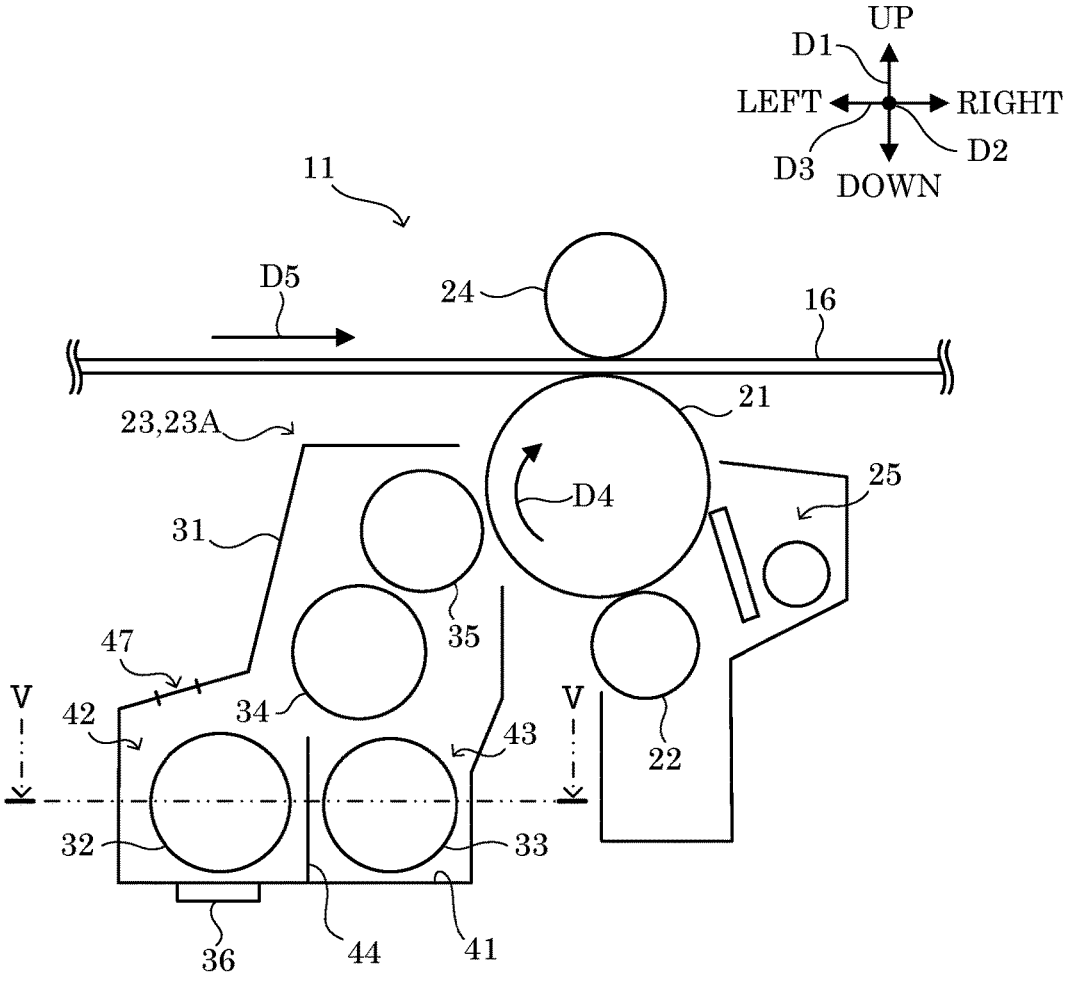
FIG. 4 is a diagram showing a configuration of an image forming unit in the image forming apparatus according to the embodiment of the present disclosure.

Next, a configuration of the image forming portion 3 is described with reference to FIG. 3 and FIG. 4. FIG. 3 is a cross-sectional diagram showing an internal configuration of the housing 9. FIG. 4 is a cross-sectional diagram showing a configuration of an image forming unit 11.

As shown in FIG. 3, the image forming portion 3 includes a plurality of image forming units 11 to 14, a laser scanning unit 15, an intermediate transfer belt 16, a secondary transfer roller 17, a fixing device 18, a toner supply device 19, and a temperature sensor 20 (see FIG. 1).

The image forming units 11 to 14 are electrophotographic image forming units, the image forming unit 11 corresponding to Y (yellow), the image forming unit 12 corresponding to C (cyan), the image forming unit 13 corresponding to M (magenta), and the image forming unit 14 corresponding to K (black). As shown in FIG. 3, the image forming units 11 to 14 are aligned along the left-right direction D3 of the image forming apparatus 100, in the order of yellow, cyan, magenta, and black from the left side of the image forming apparatus 100.

As shown in FIG. 4, the image forming unit 11 includes a photoconductor drum 21, a charging roller 22, a developing portion 23, a primary transfer roller 24, and a drum cleaning portion 25. In addition, the image forming units 12 to 14 have the same configuration as the image forming unit 11.

An electrostatic latent image is formed on a surface of the photoconductor drum 21. Upon receiving a rotational driving force supplied from a motor (not shown), the photoconductor drum 21 rotates in a rotation direction D4 as shown in FIG. 4.

The charging roller 22 electrically charges the surface of the photoconductor drum 21. Light that is emitted from the laser scanning unit 15 based on the image data, is irradiated on the surface of the photoconductor drum 21 that has been electrically charged by the charging roller 22. This allows the electrostatic latent image to be formed on the surface of the photoconductor drum 21.

The developing portion 23 develops the electrostatic latent image formed on the surface of the photoconductor drum 21 by using the developer. This allows a toner image to be formed on the surface of the photoconductor drum 21.

The primary transfer roller 24 transfers the toner image that has been formed by the developing portion 23, from the surface of the photoconductor drum 21 to the intermediate transfer belt 16.

The drum cleaning portion 25 removes the toner remaining on the surface of the photoreceptor drum 21 after the transfer of the toner image by the primary transfer roller 24.

The laser scanning unit 15 emits light based on the image data, toward surfaces of the photoconductor drums 21 of the image forming units 11 to 14.

The intermediate transfer belt 16 is an endless belt member to which the toner images formed on the surfaces of the photoconductor drums 21 of the image forming units 11 to 14 are transferred. The intermediate transfer belt 16 is stretched by a drive roller and a stretch roller with a predetermined tension. The drive roller is rotated in response to a rotational driving force that is supplied from a motor (not shown), and thereby the intermediate transfer belt 16 rotates in a rotation direction D5 as shown in FIG. 3.

The secondary transfer roller 17 transfers the toner image that has been transferred onto the surface of the intermediate transfer belt 16, to the sheet that is fed from the sheet feed portion 4.

The fixing device 18 fixes the toner image that has been transferred to the sheet by the secondary transfer roller 17, to the sheet.

The toner supply device 19 supplies the toner to the developing portions 23 of the image forming units 11 to 14.

The temperature sensor 20 detects the temperature inside the housing 9. The temperature sensor 20 is disposed at any position inside the housing 9. For example, the temperature sensor 20 is disposed at a container attachment portion 52 of the toner supply device 19. It is noted that the temperature sensor 20 may be disposed outside the housing 9 to detect the temperature of the place where the image forming apparatus 100 is installed.

[Configuration of Developing Portion 23]

Figure 5:
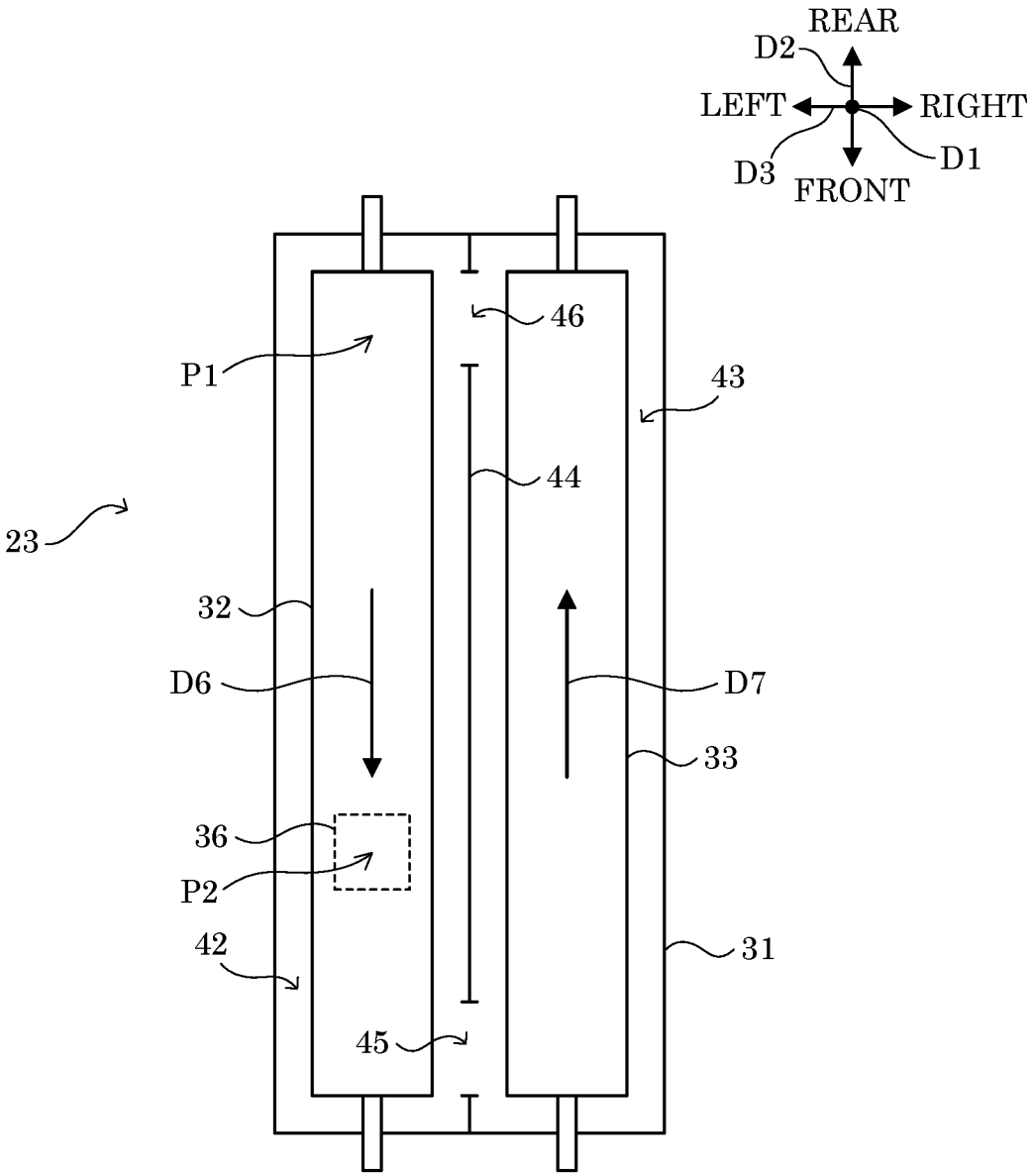
FIG. 5 is a diagram showing a configuration of a developing portion in the image forming apparatus according to the embodiment of the present disclosure.

Next, a configuration of the developing portion 23 is described with reference to FIG. 4 and FIG. 5. FIG. 5 is a cross-sectional diagram taken along a V-V line and viewed from the direction of arrows shown in FIG. 4.

As shown in FIG. 4 and FIG. 5, the developing portion 23 includes a housing 31, a first conveyance member 32, a second conveyance member 33, a magnet roller 34, a developing roller 35, and a toner sensor 36.

As shown in FIG. 4, the housing 31 stores the first conveyance member 32, the second conveyance member 33, the magnet roller 34, and the developing roller 35. In addition, the housing 31 stores the developer. Specifically, the housing 31 stores the developer in an internal space formed by side walls and a bottom surface 41. The developing portion 23 develops the electrostatic latent image that has been formed on the surface of the photoconductor drum 21 by using the developer stored in the housing 31. The housing 31 is an example of a storage portion of the present disclosure.

As shown in FIG. 5, the housing 31 includes a first conveyance path 42 and a second conveyance path 43 along which the developer including the toner is conveyed. Specifically, as shown in FIG. 4 and FIG. 5, a partition wall 44 is formed on the bottom surface 41 of the housing 31. The side walls, the bottom surface 41, and the partition wall 44 of the housing 31 form the first conveyance path 42 and the second conveyance path 43 along which the developer is conveyed in the housing 31.

As shown in FIG. 5, the first conveyance member 32 is provided in the first conveyance path 42. The first conveyance member 32 conveys the developer in a conveyance direction D6 along the front-rear direction D2 in the first conveyance path 42, and electrically charges the toner included in the developer. Specifically, the first conveyance member 32 stirs the developer during the conveyance of the developer to electrically charge the toner included in the developer. For example, the first conveyance member 32 is a screw-shaped member.

As shown in FIG. 5, the second conveyance member 33 is provided in the second conveyance path 43. The second conveyance member 33 conveys the developer in a conveyance direction D7 along the front-rear direction D2 in the second conveyance path 43, and electrically charges the toner included in the developer. Specifically, the second conveyance member 33 stirs the developer during the conveyance of the developer to electrically charge the toner included in the developer. For example, the second conveyance member 33 is a screw-shaped member.

A first connection portion 45 through which the first conveyance path 42 is connected with the second conveyance path 43, is provided at a downstream end of the partition wall 44 in the conveyance direction D6. On the other hand, a second connection portion 46 through which the first conveyance path 42 is connected with the second conveyance path 43, is provided at a downstream end of the partition wall 44 in the conveyance direction D7. This allows the developer stored in the housing 31 to be circulated and conveyed along the first conveyance path 42 and the second conveyance path 43 by the first conveyance member 32 and the second conveyance member 33.

The magnet roller 34 draws up the developer conveyed by the second conveyance member 33, from the second conveyance path 43. In addition, the magnet roller 34 supplies, to the developing roller 35, the toner included in the developer drawn up from the second conveyance path 43. The developing roller 35 develops the electrostatic latent image formed on the surface of the photoconductor drum 21, by using the toner supplied from the magnet roller 34.

It is noted that the development method adopted by the developing portion 23 is not limited to the two-component development method using the developer that includes the toner and the carrier. For example, the development method of the developing portion 23 may be one-component development method that uses only the toner. In addition, the developing portion 23 may not include the magnet roller 34.

An opening portion 47 is provided above the first conveyance path 42. As shown in FIG. 4, the opening portion 47 is provided in an upper surface of the housing 31 that covers the first conveyance path 42 from above. The opening portion 47 is provided facing an upstream end, in the conveyance direction D6, of the first conveyance path 42. The opening portion 47 is used to charge the toner supplied from a toner container 51, into the first conveyance path 42, wherein the toner container 51 is described below. Specifically, the toner supplied from the toner container 51 is charged into the first conveyance path 42 through the opening portion 47 at a charging position P1 (see FIG. 5) of the first conveyance path 42. The charging position P1 is a position on the bottom surface 41 facing the opening portion 47.

The toner sensor 36 detects an amount of toner at a detection position P2 (see FIG. 5) positioned on a more downstream side in the conveyance direction D6 than the charging position P1 in the first conveyance path 42. For example, as shown in FIG. 4, the toner sensor 36 is provided at a bottom surface portion of the housing 31. For example, the toner sensor 36 is a magnetic permeability sensor including an LC oscillation circuit that outputs an electric signal corresponding to a magnetic permeability of the developer stored in the housing 31.

For example, in the image forming apparatus 100, the amount of toner stored in the housing 31 is obtained by integrating the values detected by the toner sensor 36 during a detection period that is longer than the time required for the first conveyance member 32 to convey the toner from the charging position P1 to the detection position P2. For example, the detection period equals to the time required for the toner conveyed by the first conveyance member 32 to circulate inside the developing portion 23 once.

[Configuration of Toner Supply Device 19]

Figure 6:
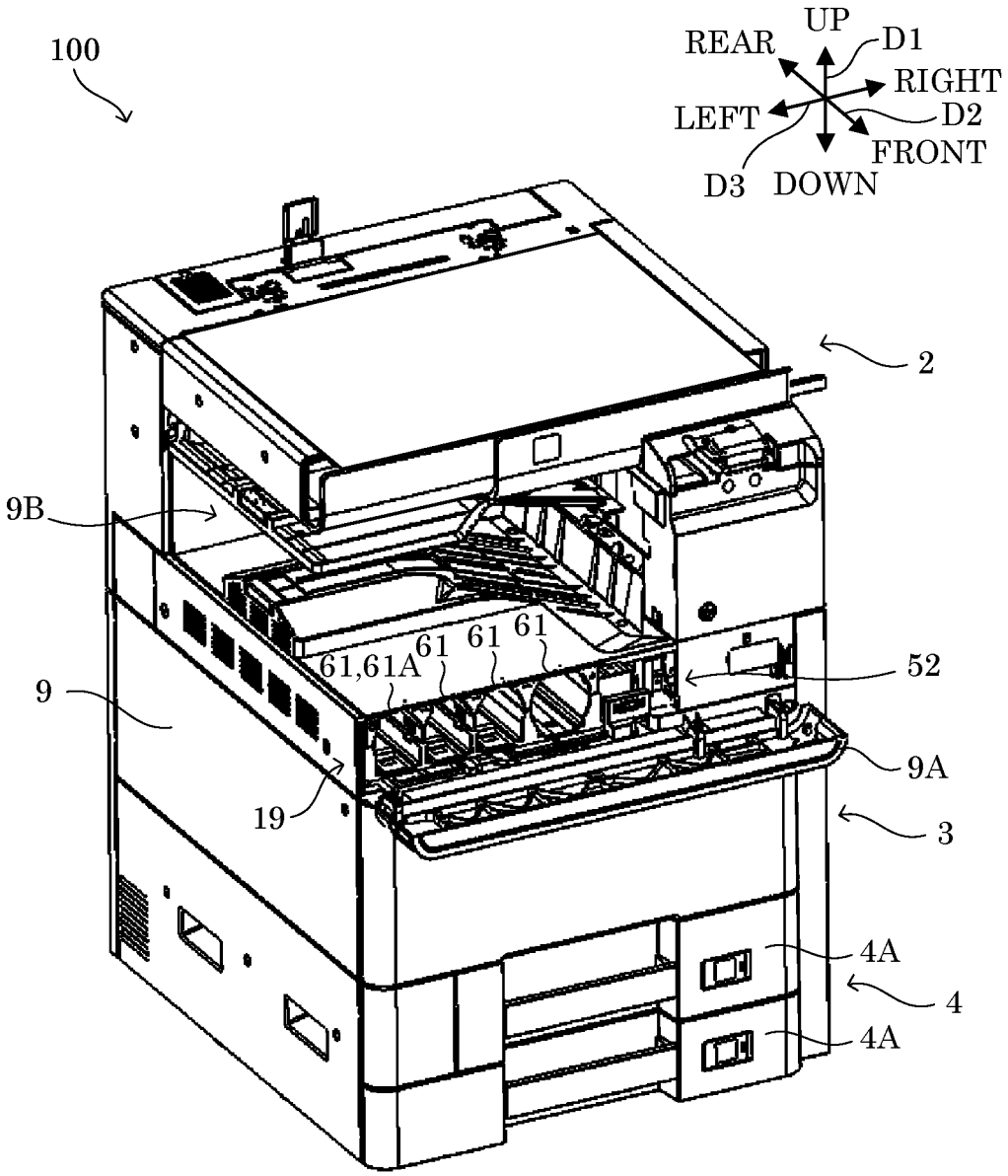
FIG. 6 is a diagram showing an outer appearance of the image forming apparatus according to the embodiment of the present disclosure.
Figure 7:
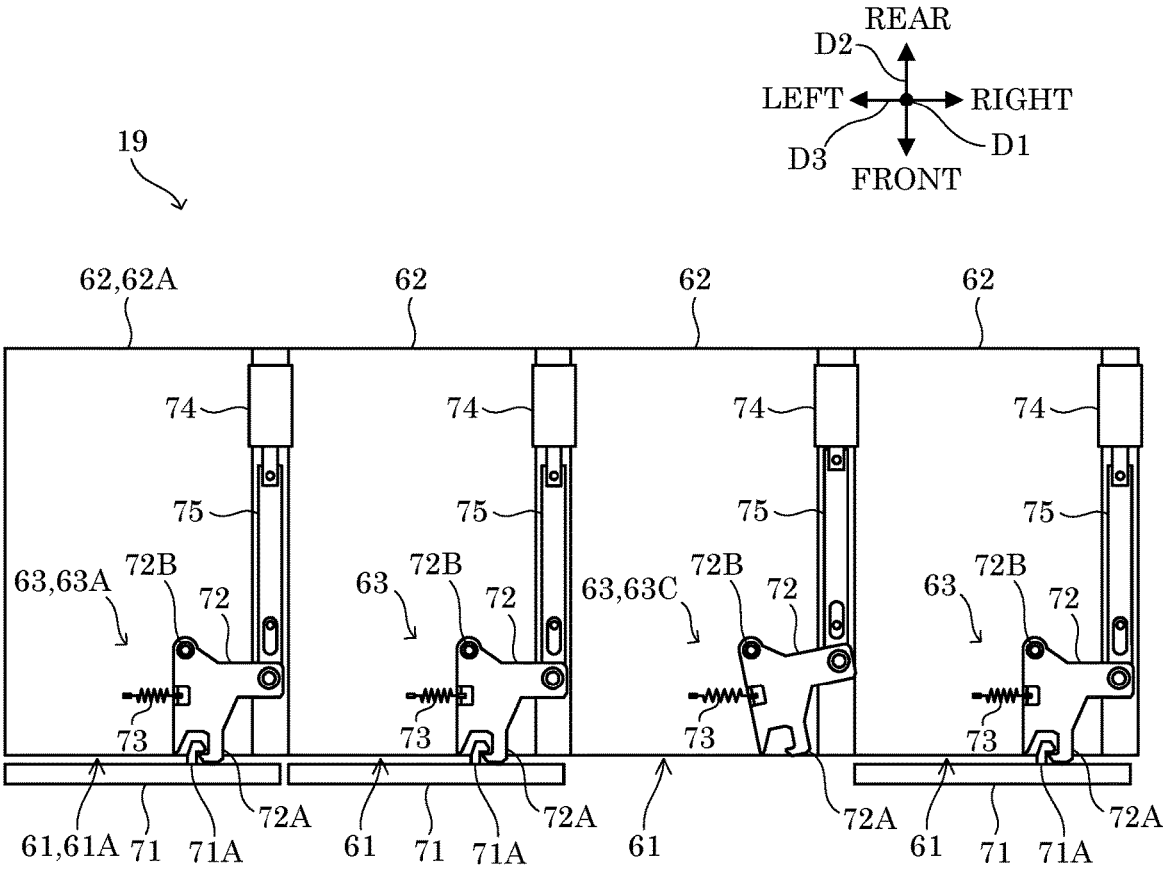
FIG. 7 is a diagram showing a configuration of a toner supply device in the image forming apparatus according to the embodiment of the present disclosure.

Next, a configuration of the toner supply device 19 is described with reference to FIG. 1 to FIG. 3 and FIG. 6 to FIG. 7. FIG. 6 is a diagram showing a state where a lock unit 53 is removed from the image forming apparatus 100 shown in FIG. 2. In addition, FIG. 7 is a plan diagram showing a configuration of the toner supply device 19.

The toner supply device 19 includes four toner containers 51 shown in FIG. 3, a container attachment portion 52 shown in FIG. 6, and the lock unit 53 shown in FIG. 2. In addition, as shown in FIG. 1, the toner supply device 19 includes a drive portion 54, a data acquiring portion 55, and an open/closed sensor 56.

The four toner containers 51 are provided in correspondence with the image forming units 11 to 14. For example, a toner container 51A shown in FIG. 3 corresponds to the image forming unit 11 and stores yellow toner.

The four toner containers 51 have the same configuration. Specifically, the toner containers 51 are each formed approximately in the shape of a cylinder elongated along the front-rear direction D2. Each toner container 51 includes a conveyance member (not shown) that conveys the toner stored therein along the longitudinal direction thereof, and an IC tag (not shown) that stores specific data regarding the toner container 51. For example, the specific data includes identification information of the toner container 51, toner information regarding the type, material, and color of the toner stored in the toner container 51, and initial storage amount information that indicates an initial storage amount of toner in the toner container 51. The toner container 51 is an example of a developer storage portion of the present disclosure.

Four toner containers 51 are attached to the container attachment portion 52. As shown in FIG. 3, the container attachment portion 52 is provided at an upper part of the housing 9. In addition, as shown in FIG. 6, the container attachment portion 52 is provided in the housing 9 at a position facing a back surface of the front cover 9A. Four opening portions 61 (see FIG. 6) and four attachment portions 62 (see FIG. 3) are formed in the container attachment portion 52.

The four opening portions 61 are provided in correspondence with the four toner containers 51. The toner containers 51 are respectively inserted in the opening portions 61. For example, the toner container 51A is inserted in an opening portion 61A shown in FIG. 6.

The four attachment portions 62 are provided in correspondence with the four opening portions 61. Each attachment portion 62 forms a storage space for storing a toner container 51 that extends from the corresponding opening portion 61 toward the rear of the image forming apparatus 100. The toner containers 51 are respectively attached to the attachment portions 62. For example, the toner container 51A is attached to an attachment portion 62A shown in FIG. 3.

The lock unit 53 is configured to regulate removal of the toner containers 51 attached to the container attachment portion 52, from the container attachment portion 52. As shown in FIG. 2, the lock unit 53 is mounted to the front of the container attachment portion 52. The lock unit 53 includes four lock devices 63 that are configured to individually switch between placing and not placing restrictions on opening and closing of the four opening portions 61. That is, the four lock devices 63 are configured to individually switch between locking and unlocking the four opening portions 61.

The four lock devices 63 have the same configuration. Specifically, as shown in FIG. 7, each lock device 63 includes a lock cover 71, a restriction member 72, a coil spring 73, a solenoid 74, and a link member 75. The restriction member 72, the coil spring 73, the solenoid 74, and the link member 75 in each lock device 63 are provided on an upper surface of the corresponding attachment portion 62. Each lock device 63 regulates the removal of a toner container 51 attached to a corresponding attachment portion 62, from the attachment portion 62. The lock device 63 is an example of a regulation portion of the present disclosure.

The lock cover 71 is provided at each opening portion 61 in such a way as to open and close the opening portion 61. The lock cover 71 is supported such that its lower end portion is pivotable around a rotary shaft that is elongated in the left-right direction D3. That is, the lock cover 71 is opened as its upper part pivots forward, in the same manner as the front cover 9A.

An engaged portion 71A configured to be engaged with an engaging portion 72A of the restriction member 72, is provided at the upper part of the lock cover 71. As shown in FIG. 7, the engaged portion 71A has a hook shape that protrudes from the back surface of the lock cover 71 and bends to the right.

The restriction member 72 includes the engaging portion 72A configured to be engaged with the engaged portion 71A of the lock cover 71. As shown in FIG. 7, the engaging portion 72A has a hook shape that protrudes forward and bends to the left. The restriction member 72 is pivotably provided on the upper surface of each attachment portion 62. Specifically, the restriction member 72 is pivotably supported by a rotary shaft 72B that is provided parallel to the up-down direction D1, on the upper surface of each attachment portion 62.

The restriction member 72 is configured to be rotated between: a lock position where opening of the lock cover 71 is restricted; and a release position where restriction on opening of the lock cover 71, namely lock of the lock cover 71, is released. Here, as shown in FIG. 7, the lock position is a position where the engaging portion 72A is engaged with the engaged portion 71A of the closed lock cover 71. In addition, the release position is more inside the lock cover 71 than the lock position, and is a position where the engagement between the engaging portion 72A and the engaged portion 71A of the lock cover 71 is released (see a lock device 63C in FIG. 7). In the lock device 63, opening of the lock cover 71 is restricted by the restriction member 72, and thereby attachment/detachment of a toner container 51 to/from the corresponding attachment portion 62 is regulated.

The coil spring 73 biases the restriction member 72 toward the lock position. Specifically, as shown in FIG. 7, the coil spring 73 is provided on the upper surface of each attachment portion 62 to extend in the left-right direction D3. One end of the coil spring 73 in the longitudinal direction thereof is fixed to a left side portion of the restriction member 72, the other end being fixed to the upper surface of each attachment portion 62. The coil spring 73 is fixed to the restriction member 72 and the upper surface of each attachment portion 62 in a state of being stretched to be longer than its natural length. Therefore, the restriction member 72 is pulled by the coil spring 73 leftward and biased toward the lock position.

As shown in FIG. 7, the solenoid 74 is provided more inside the lock cover 71 than the restriction member 72. The solenoid 74 is driven in response to energization to move the restriction member 72 to the release position. Specifically, the solenoid 74 has what is called a pull-type driven configuration, and has a plunger that is elongated in the front-rear direction D2. The plunger is connected to the restriction member 72 via the link member 75 that is elongated in the front-rear direction D2.

The solenoid 74 drives the plunger rearward in response to a power supply from a power source (not shown) that is started based on a control instruction from the first control portion 7. This allows the restriction member 72 that is connected to the plunger via the link member 75, to be moved from the lock position to the release position, releasing the lock of the lock cover 71 (see the lock device 63C in FIG. 7).

The drive portion 54 is provided in each attachment portion 62. The drive portion 54 generates a rotational driving force that is supplied to the conveyance member of a toner container 51 attached to an attachment portion 62 corresponding to the drive portion 54. For example, the drive portion 54 is a motor. The rotational driving force generated in the drive portion 54 is supplied to the conveyance member of the toner container 51 attached to the corresponding attachment portion 62 via a power transmission mechanism (not shown). This allows the conveyance member to be rotated so that the toner stored in the toner container 51 is conveyed to a toner outlet (not shown) provided inside the toner container 51. The toner outlet of the toner container 51 attached to the corresponding attachment portion 62 is connected to a toner supply path (not shown) leading to the opening portion 47 (see FIG. 4) of the developing portion 23. The toner that is discharged from the toner outlet to the outside of the toner container 51 is supplied to the developing portion 23 via the toner supply path and the opening portion 47.

The data acquiring portion 55 is provided in each attachment portion 62. The data acquiring portion 55 acquires the specific data from the IC tag of a toner container 51 attached to an attachment portion 62 corresponding to the data acquiring portion 55. For example, the data acquiring portion 55 receives the specific data from the IC tag by executing short-range wireless communication with the IC tag of the toner container 51 attached to the corresponding attachment portion 62.

The open/closed sensor 56 detects whether the front cover 9A of the housing 9 is in an open state or a closed state. For example, the open/closed sensor 56 is a reflective optical sensor.

[Configuration of First Control Portion 7]

Next, a configuration of the first control portion 7 is described with reference to FIG. 1.

As shown in FIG. 1, the first control portion 7 includes an authentication processing portion 91, a supply processing portion 92, a first release processing portion 93, an acquisition processing portion 94, a second release processing portion 95, a notification processing portion 96, and a restriction processing portion 97.

Specifically, a regulation release program for causing the CPU 7A of the first control portion 7 to execute a regulation release process (see a flowchart of FIG. 8) and a print control process (see a flowchart of FIG. 9) that are described below, is preliminarily stored in the ROM 7B of the first control portion 7. The CPU 7A of the first control portion 7 functions as the above-described portions by executing the regulation release program stored in the ROM 7B.

It is noted that the regulation release program may be recorded on a non-transitory computer-readable recording medium such as a CD, a DVD, or a flash memory, and may be read from the recording medium and installed in a storage device such as the storage portion 6.

The following describes an example case where, among the developing portions 23, the toner containers 51, the attachment portions 62, and the lock devices 63 corresponding to the image forming units 11 to 14, the developing portion 23A (see FIG. 4), the toner container 51A (see FIG. 3), the attachment portion 62A (see FIG. 3), and the lock device 63A (see FIG. 2) corresponding to the image forming unit 11 are focused. The following description also applies to the toner containers 51, the attachment portions 62, and the lock devices 63 that correspond to the image forming units 12 to 14.

The authentication processing portion 91 is configured to authenticate the users of the image forming apparatus 100. For example, the authentication processing portion 91 authenticates the users of the image forming apparatus 100 by using the authentication information stored in the storage portion 6.

For example, the authentication processing portion 91 displays an authentication screen on the operation/display portion 5 in response to a predetermined call operation performed on the operation/display portion 5, wherein the authentication screen is used for a predetermined authentication operation. The authentication processing portion 91 receives the authentication operation on the authentication screen. For example, the authentication operation is an operation to input a user name and a password. Thereafter, when the information input from the operation/display portion 5 matches any piece of authentication information stored in the storage portion 6, the authentication processing portion 91 authenticates the user. That is, the authentication processing portion 91 allows the user to log in the image forming apparatus 100.

It is noted that the authentication processing portion 91 executes a log-out process to log out a currently logged-in user when a predetermined log-out operation has been performed on the operation/display portion 5, when a predetermined set time has passed, or when another user needs to be logged in.

When an amount of toner stored in the housing 31 of the development portion 23A is equal to or smaller than a predetermined first threshold, the supply processing portion 92 supplies the toner from the toner container 51A attached to the attachment portion 62A to the housing 31 of the developing portion 23A. This allows the amount of toner stored in the housing 31 of the developing portion 23A to be maintained within a predetermined range that includes the first threshold, until a remaining amount of toner in the toner container 51A is sufficiently reduced.

Specifically, the supply processing portion 92 acquires the amount of toner stored in the housing 31 of the developing portion 23A by using the toner sensor 36 of the developing portion 23A. In addition, the supply processing portion 92 supplies the toner from the toner container 51A attached to the attachment portion 62A to the housing 31 of the development portion 23A, by driving the drive portion 54 corresponding to the attachment portion 62A to rotate the conveyance member inside the toner container 51A by a predetermined reference amount.

For example, during an execution of a print process to form an image on a sheet using the image forming portion 3, the supply processing portion 92 determines in a predetermined determination cycle whether or not the amount of toner stored in the housing 31 of the developing portion 23A is equal to or smaller than the first threshold.

When the amount of toner stored in the housing 31 of the developing portion 23A is equal to or smaller than a second threshold that is smaller than the first threshold, the first release processing portion 93 releases regulation on the removal of the toner container 51A imposed by the lock device 63A. With this configuration, as compared with a configuration where the toner container 51A can be replaced at an arbitrary timing, it is possible to reduce the remaining amount of toner in the toner container 51A at the time of a replacement of the toner container 51A.

For example, when the amount of toner stored in the housing 31 of the developing portion 23A that was acquired last during a print process executed immediately before, is equal to or smaller than the second threshold, the first release processing portion 93 waits for a predetermined specific operation to be performed by the user. For example, the specific operation is an operation to open the front cover 9A. For example, the first release processing portion 93 detects the opening of the front cover 9A by using the open/closed sensor 56. It is noted that the specific operation may be a predetermined operation performed on the operation/display portion 5.

When the specific operation performed by the user is detected, the first release processing portion 93 releases regulation on the removal of the toner container 51A imposed by the lock device 63A. Specifically, the first release processing portion 93 drives the solenoid 74 of the lock device 63A to move the restriction member 72 of the lock device 63A from the lock position to the release position, thereby releasing regulation on the removal of the toner container 51A imposed by the lock device 63A.

It is noted that when the amount of toner stored in the housing 31 of the developing portion 23A that was acquired last during a print process executed immediately before, is equal to or smaller than the second threshold, the first release processing portion 93 may release regulation on the removal of the toner container 51A imposed by the lock device 63A, regardless of whether or not the specific operation is performed.

Meanwhile, the toner container 51A might be replaced when the remaining amount of toner in the toner container 51A is sufficiently reduced even if the amount of toner stored in the developing portion 23A is larger than the second threshold. This would also make it possible to reduce the remaining amount of toner in the toner container 51A at the time of replacement of the toner container 51A. However, in conventional image forming apparatuses, it is determined based on only the amount of toner stored in the developing portion 23A whether or not to permit a replacement of the toner container 51A. This excessively restricts the opportunity for the user to replace the toner container 51A.

On the other hand, as described below, the image forming apparatus 100 according to the embodiment of the present disclosure is configured to reduce the remaining amount of toner in the toner container 51 at the time of replacement and increase the opportunity to replace the toner container 51.

The acquisition processing portion 94 acquires the remaining amount of toner in the toner container 51A attached to the attachment portion 62A when the amount of toner stored in the housing 31 of the developing portion 23A is larger than the second threshold.

For example, in the image forming apparatus 100, each time the print process is executed, an amount of toner consumed in the print process is recorded. For example, the first control portion 7 acquires the amount of toner consumed in the print process based on a printing rate of the image data printed in the print process. In addition, the first control portion 7 stores the acquired consumed amount of toner in a predetermined storage area of the storage portion 6, together with information of the execution timing of the print process or the like. It is noted that the first control portion 7 may acquire the amount of toner consumed in the print process based on a rotation amount of the conveyance member provided in the toner container 51A.

The acquisition processing portion 94 acquires the remaining amount of toner in the toner container 51A attached to the attachment portion 62A based on: the total amount of toner consumed from the use start timing of the toner container 51A; and the initial storage amount information included in the specific data acquired from the IC tag of the toner container 51A by the data acquiring portion 55 corresponding to the attachment portion 62A.

The second release processing portion 95 is configured to release regulation on the removal of the toner container 51A imposed by the lock device 63A, based on the remaining amount of toner acquired by the acquisition processing portion 94.

For example, the second release processing portion 95 releases regulation on the removal of the toner container 51A imposed by the lock device 63A when the remaining amount of toner acquired by the acquisition processing portion 94 is equal to or smaller than a predetermined first reference value in a case where the temperature in the image forming apparatus 100 is equal to or higher than a predetermined reference temperature. For example, the temperature in the image forming apparatus 100 is detected by the temperature sensor 20. In addition, the reference temperature is 10 degrees. In addition, the first reference value is 60 grams. It is noted that the reference temperature may be determined in an arbitrary manner to fall within a range considered to influence the solidification of the toner in the toner container 51A.

In addition, the second release processing portion 95 releases regulation on the removal of the toner container 51A imposed by the lock device 63A in a case where the temperature in the image forming apparatus 100 is lower than the reference temperature when the remaining amount of toner acquired by the acquisition processing portion 94 is equal to or smaller than a second reference value that is greater than the first reference value. For example, the second reference value is 90 grams. It is noted that the first reference value and the second reference value may be determined in an arbitrary manner.

For example, when the remaining amount of toner acquired by the acquisition processing portion 94 is equal to or smaller than the first reference value or the second reference value, the second release processing portion 95 waits for the specific operation to be performed by the user. Subsequently, upon detecting the specific operation performed by the user, the second release processing portion 95 releases regulation on the removal of the toner container 51A imposed by the lock device 63A.

It is noted that when the remaining amount of toner acquired by the acquisition processing portion 94 is equal to or smaller than the first reference value or the second reference value, the second release processing portion 95 may release regulation on the removal of the toner container 51A imposed by the lock device 63A regardless of whether or not the specific operation is performed.

When the second release processing portion 95 releases regulation on the removal of the toner container 51A in a case where the temperature in the image forming apparatus 100 is equal to or higher than the reference temperature, the notification processing portion 96 notifies the user that a timing to replace the toner container 51A has come.

For example, the notification processing portion 96 displays, on the operation/display portion 5, a first notification screen that includes a message that a timing to replace the toner container 51A has come.

In addition, when the second release processing portion 95 releases regulation on the removal of the toner container 51A in a case where the temperature in the image forming apparatus 100 is lower than the reference temperature, the notification processing portion 96 notifies the user that the fluidity of the toner in the toner container 51A has decreased.

For example, the notification processing portion 96 displays, on the operation/display portion 5, a second notification screen that includes: a message that the fluidity of the toner in the toner container 51A has decreased; and a message that the decrease of the fluidity of the toner can be improved by shaking the toner container 51A.

When the amount of toner stored in the housing 31 of the developing portion 23A is equal to or smaller than a third threshold that is lower than the second threshold, the restriction processing portion 97 imposes restriction on the operation of the image forming portion 3 and releases regulation on the removal of the toner container 51A imposed by the lock device 63A.

Specifically, when the amount of toner stored in the housing 31 of the developing portion 23A that is acquired by using the toner sensor 36 of the developing portion 23A, is equal to or smaller than the third threshold, the restriction processing portion 97 stops a currently executed print process and prohibits the print process from being newly executed.

In addition, when the amount of toner stored in the housing 31 of the developing portion 23A that is acquired by using the toner sensor 36 of the developing portion 23A, is equal to or smaller than the third threshold, the restriction processing portion 97 waits for the specific operation to be performed by the user.

Subsequently, upon detecting the specific operation performed by the user, the restriction processing portion 97 releases regulation on the removal of the toner container 51A imposed by the lock device 63A.

It is noted that when the amount of toner stored in the housing 31 of the developing portion 23A that is acquired by using the toner sensor 36 of the developing portion 23A, is equal to or smaller than the third threshold, the restriction processing portion 97 may release regulation on the removal of the toner container 51A imposed by the lock device 63A regardless of whether or not the specific operation is performed.

It is noted that the first control portion 7 may not include the authentication processing portion 91. In addition, the first control portion 7 may not include the notification processing portion 96. In addition, the first control portion 7 may not include the first release processing portion 93. In this case, the restriction processing portion 97 is an example of the first release processing portion of the present disclosure.

[Regulation Release Process]

Figure 8:
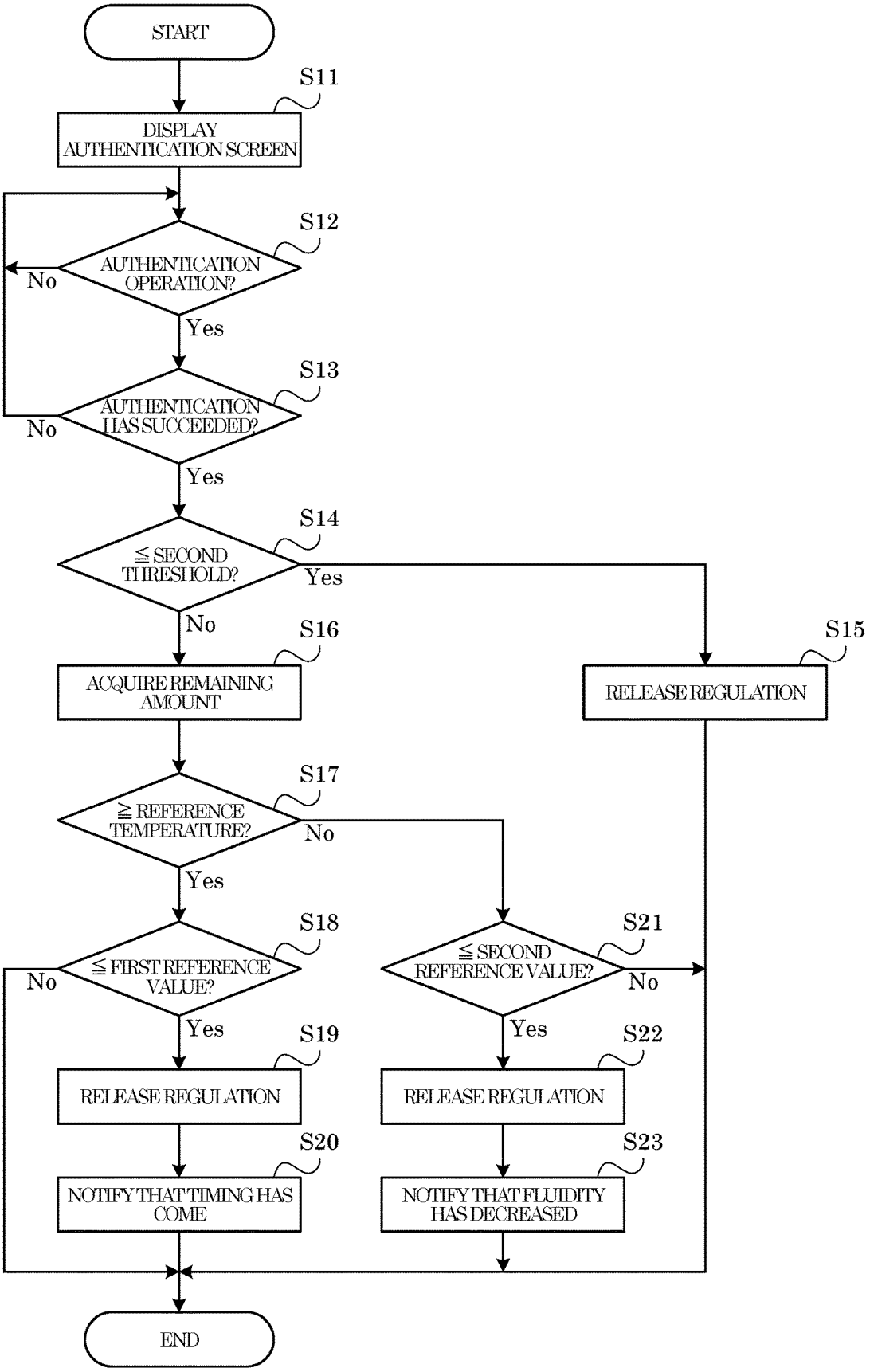
FIG. 8 is a flowchart showing an example of a regulation release process that is executed in the image forming apparatus according to the embodiment of the present disclosure.

In the following, with reference to FIG. 8, a description is given of an example of the procedure of a regulation release process executed by the first control portion 7 in the image forming apparatus 100. Here, steps S11, S12, . . . represent numbers assigned to the processing procedures (steps) executed by the first control portion 7. It is noted that the regulation release process is executed when the call operation has been performed.

<Step S11>

First, in step S11, the first control portion 7 displays the authentication screen on the operation/display portion 5.

<Step S12>

In step S12, the first control portion 7 determines whether or not the authentication operation has been performed on the authentication screen displayed in step S11.

Here, upon determining that the authentication operation has been performed (Yes side at S12), the first control portion 7 moves the process to step S13. In addition, upon determining that the authentication operation has not been performed (No side at S12), the first control portion 7 waits at step S12 for the authentication operation to be performed.

<Step S13>

In step S13, the first control portion 7 determines whether or not the authentication of the user has succeeded based on the authentication operation. It is noted that the processes of steps S11 to S13 are executed by the authentication processing portion 91 of the first control portion 7.

Here, upon determining that the authentication of the user has succeeded (Yes side at S13), the first control portion 7 moves the process to step S14. In addition, upon determining that the authentication of the user has not succeeded (No side at S13), the first control portion 7 moves the process to step S12.

It is noted that the processes of steps S11 to S13 may be omitted. In this case, the regulation release process may be executed at a timing when the image forming apparatus 100 is powered on, at a timing when the operation mode of the image forming apparatus 100 is switched from a power saving mode in which lower power is consumed than in a normal mode, to the normal mode, or at a timing when the print process ends.

<Step S14>

In step S14, the first control portion 7 determines whether or not the amount of toner stored in the housing 31 of the developing portion 23A is equal to or smaller than the second threshold.

For example, the first control portion 7 determines whether or not the amount of toner stored in the housing 31 of the developing portion 23A that was acquired last during a print process executed immediately before, is equal to or smaller than the second threshold.

Here, upon determining that the amount of toner stored in the housing 31 of the developing portion 23A is equal to or smaller than the second threshold (Yes side at S14), the first control portion 7 moves the process to step S15. In addition, upon determining that the amount of toner stored in the housing 31 of the developing portion 23A is not equal to or smaller than the second threshold (No side at S14), the first control portion 7 moves the process to step S16.

<Step S15>

In step S15, the first control portion 7 releases regulation on the removal of the toner container 51A imposed by the lock device 63A. Here, the processes of steps S14 and S15 are an example of a first release step of the present disclosure and is executed by the first release processing portion 93 of the first control portion 7.

For example, the first control portion 7 waits for the specific operation to be performed by the user, and upon detecting the specific operation performed by the user, the first control portion 7 releases regulation on the removal of the toner container 51A imposed by the lock device 63A.

<Step S16>

In step S16, the first control portion 7 acquires the remaining amount of toner in the toner container 51A. Here, the process of step S16 is an example of an acquisition step of the present disclosure and is executed by the acquisition processing portion 94 of the first control portion 7.

<Step S17>

In step S17, the first control portion 7 determines whether or not the temperature in the image forming apparatus 100 is equal to or higher than the reference temperature.

Here, upon determining that the temperature in the image forming apparatus 100 is equal to or higher than the reference temperature (Yes side at S17), the first control portion 7 moves the process to step S18. In addition, upon determining that the temperature in the image forming apparatus 100 is not equal to or higher than the reference temperature (No side at S17), the first control portion 7 moves the process to step S21.

<Step S18>

In step S18, the first control portion 7 determines whether or not the remaining amount of toner acquired in step S16 is equal to or smaller than the first reference value.

Here, upon determining that the remaining amount of toner acquired in step S16 is equal to or smaller than the first reference value (Yes side at S18), the first control portion 7 moves the process to step S19. In addition, upon determining that the remaining amount of toner acquired in step S16 is not equal to or smaller than the first reference value (No side at S18), the first control portion 7 ends the regulation release process.

<Step S19>

In step S19, the first control portion 7 releases regulation on the removal of the toner container 51A imposed by the lock device 63A. Here, the processes of steps S17, S18, and S19 are an example of a second release step of the present disclosure and are executed by the second release processing portion 95 of the first control portion 7.

For example, the first control portion 7 waits for the specific operation to be performed by the user, and upon detecting the specific operation performed by the user, the first control portion 7 releases regulation on the removal of the toner container 51A imposed by the lock device 63A.

<Step S20>

In step S20, the first control portion 7 notifies the user that a timing to replace the toner container 51A has come. It is noted that the process of step S20 is executed by the notification processing portion 96 of the first control portion 7.

For example, the first control portion 7 displays, on the operation/display portion 5, the first notification screen that includes a message that a timing to replace the toner container 51A has come. It is noted that the first notification screen may be displayed during a wait for the specific operation.

<Step S21>

In step S21, the first control portion 7 determines whether or not the remaining amount of toner acquired in step S16 is equal to or smaller than the second reference value.

Here, upon determining that the remaining amount of toner acquired in step S16 is equal to or smaller than the second reference value (Yes side at S21), the first control portion 7 moves the process to step S22. In addition, upon determining that the remaining amount of toner acquired in step S16 is not equal to or smaller than the second reference value (No side at S21), the first control portion 7 ends the regulation release process.

<Step S22>

In step S22, as in step S19, the first control portion 7 releases regulation on the removal of the toner container 51A imposed by the lock device 63A. Here, the processes of steps S17, S21, and S22 are an example of a second release step of the present disclosure and are executed by the second release processing portion 95 of the first control portion 7.

<Step S23>

In step S23, the first control portion 7 notifies the user that the fluidity of the toner in the toner container 51A has decreased. It is noted that the process of step S23 is executed by the notification processing portion 96 of the first control portion 7.

For example, the first control portion 7 displays, on the operation/display portion 5, the second notification screen that includes: a message that the fluidity of the toner in the toner container 51A has decreased; and a message that the decrease of the fluidity of the toner can be improved by shaking the toner container 51A. It is noted that the second notification screen may be displayed during a wait for the specific operation.

[Print Control Process]

Figure 9:
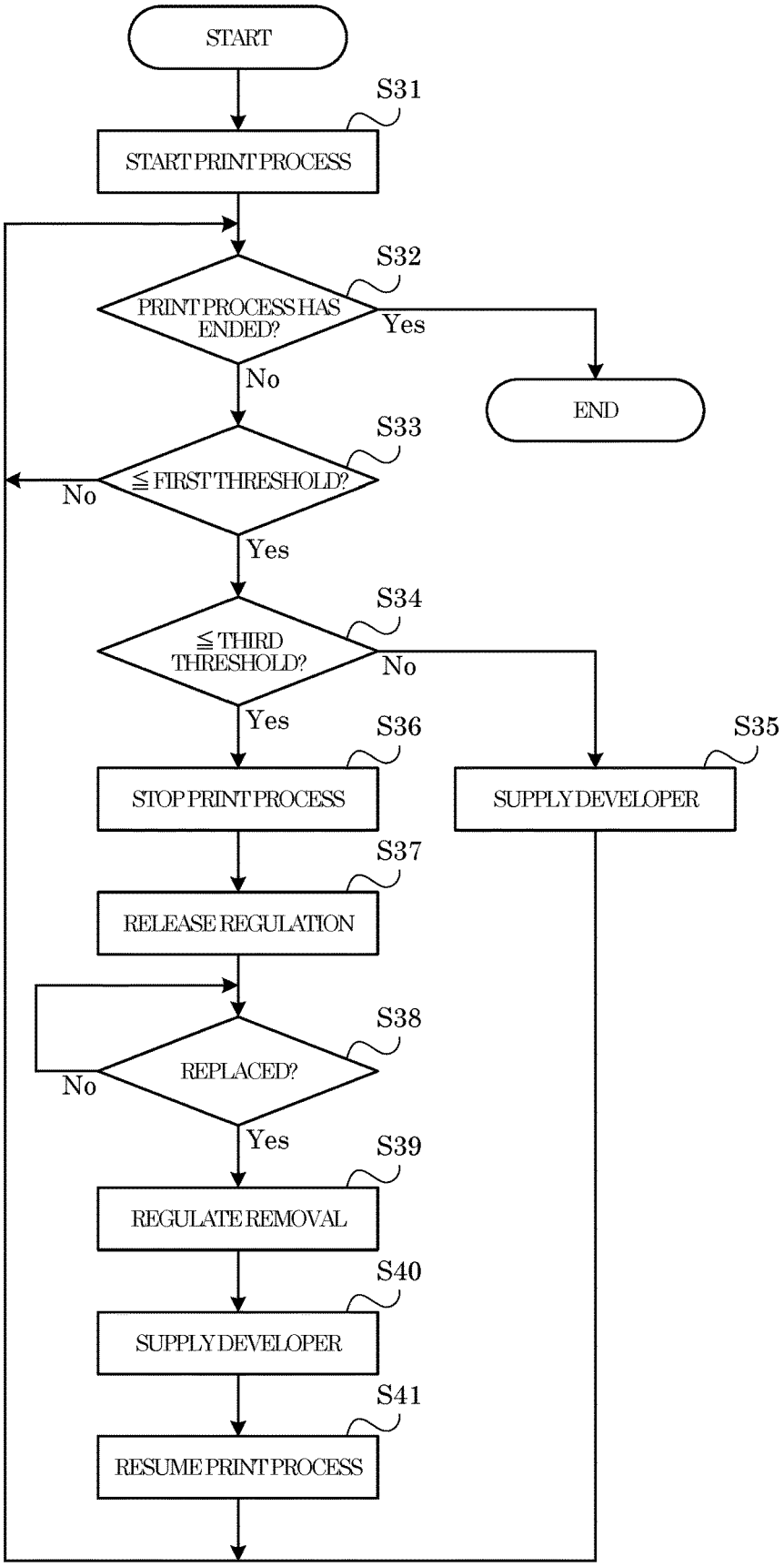
FIG. 9 is a flowchart showing an example of a print control process that is executed in the image forming apparatus according to the embodiment of the present disclosure.

Next, with reference to FIG. 9, a description is given of an example of the procedure of the print control process executed by the first control portion 7 in the image forming apparatus 100. It is noted that the print control process is executed when an instruction to execute the print process is input.

<Step S31>

First, in step S31, the first control portion 7 starts an execution-target print process.

<Step S32>

In step S32, the first control portion 7 determines whether or not the execution-target print process has ended.

Here, upon determining that the execution-target print process has ended (Yes side at S32), the first control portion 7 ends the print control process. In addition, upon determining that the execution-target print process has not ended (No side at S32), the first control portion 7 moves the process to step S33.

<Step S33>

In step S33, the first control portion 7 determines whether or not the amount of toner stored in the housing 31 of the developing portion 23A is equal to or smaller than the first threshold.

Here, upon determining that the amount of toner stored in the housing 31 of the developing portion 23A is equal to or smaller than the first threshold (Yes side at S33), the first control portion 7 moves the process step S34. In addition, upon determining that the amount of toner stored in the housing 31 of the developing portion 23A is not equal to or smaller than the first threshold (No side at S33), the first control portion 7 moves the process to step S32. In this case, the first control portion 7 executes the process of step S33 in the determination cycle until the print process ends.

<Step S34>

In step S34, the first control portion 7 determines whether or not the amount of toner stored in the housing 31 of the developing portion 23A is equal to or smaller than the third threshold.

Here, upon determining that the amount of toner stored in the housing 31 of the developing portion 23A is equal to or smaller than the third threshold (Yes side at S34), the first control portion 7 moves the process step S36. In addition, upon determining that the amount of toner stored in the housing 31 of the developing portion 23A is not equal to or smaller than the third threshold (No side at S34), the first control portion 7 moves the process to step S35.

<Step S35>

In step S35, the first control portion 7 supplies the toner from the toner container 51A attached to the attachment portion 62A to the housing 31 of the development portion 23A. Here, the processes of steps S33 and S35 are an example of a supply step of the present disclosure, and is executed by the supply processing portion 92 of the first control portion 7.

<Step S36>

In step S36, the first control portion 7 stops the print process.

<Step S37>

In step S37, the first control portion 7 releases regulation on the removal of the toner container 51A imposed by the lock device 63A. It is noted that the processes of steps S34, S36, and S37 are executed by the restriction processing portion 97 of the first control portion 7.

For example, the first control portion 7 waits for the specific operation to be performed by the user, and upon detecting the specific operation performed by the user, the first control portion 7 releases regulation on the removal of the toner container 51A imposed by the lock device 63A.

<Step S38>

In step S38, the first control portion 7 determines whether or not the toner container 51A has been replaced.

For example, when closing of the front cover 9A is detected by the open/closed sensor 56 while the toner container 51A is attached to the attachment portion 62A, the first control portion 7 determines that the toner container 51A has been replaced. It is noted that the first control portion 7 may determine whether or not the toner container 51A is attached to the attachment portion 62A, based on, for example, success or failure of acquisition of the specific data by the data acquisition portion 55 corresponding to the attachment portion 62A. It is noted that the first control portion 7 may determine whether or not the toner container 51A attached to the attachment portion 62A is a newly replaced one, based on the specific data acquired by the data acquiring portion 55.

Here, upon determining that the toner container 51A has been replaced (Yes side at S38), the first control portion 7 moves the process step S39. In addition, upon determining that the toner container 51A has not been replaced (No side at S38), the first control portion 7 waits at step S38 for the toner container 51A to be replaced.

<Step S39>

In step S39, the first control portion 7 regulates removal of the toner container 51A from the attachment portion 62A.

Specifically, the first control portion 7 stops a power supply to the solenoid 74 of the lock device 63A so as to move the restriction member 72 of the lock device 63A from the release position to the lock position. This allows the lock device 63A to regulate the removal of the toner container 51A.

It is noted that after starting the power supply to the solenoid 74 of the lock device 63A, the first control portion 7 may stop the power supply to the solenoid 74 after a predetermined time lapses. In this case, the engaged portion 71A of the lock cover 71 of the lock device 63A may be engaged with the engaging portion 72A of the restriction member 72 of the lock device 63A by snap fitting in response to a closing of the lock cover 71. In addition, the process of step S39 may be omitted.

<Step S40>

In step S40, the first control portion 7 supplies the toner from the toner container 51A attached to the attachment portion 62A to the housing 31 of the development portion 23A.

For example, the first control portion 7 supplies the toner from the toner container 51A to the housing 31 until the amount of toner stored in the housing 31 of the developing portion 23A exceeds a predetermined fourth threshold that is greater than the third threshold.

<Step S41>

In step S41, the first control portion 7 resumes the execution-target print process that was stopped in step S36.

As described above, in the image forming apparatus 100, when the amount of toner stored in the developing portion 23A exceeds the second threshold, it is determined, based on the remaining amount of toner in the toner container 51A, whether or not to release regulation on the removal of the toner container 51A imposed by the lock device 63A. With this configuration, it is possible to release regulation on the removal of the toner container 51A imposed by the lock device 63A when the remaining amount of toner in the toner container 51A is sufficiently reduced even when the amount of toner stored in the developing portion 23A is larger than the second threshold. As a result, it is possible to reduce the remaining amount of toner in the toner container 51A at the time of replacement of the toner container 51A, and increase the opportunity for the user to replace the toner container 51A.

The present disclosure may be applied to an image forming apparatus that forms an image by another image forming method such as an inkjet method.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an attachment portion to which a developer storage portion storing developer is attached;

a lock device configured to regulate removal of the developer storage portion attached to the attachment portion from the attachment portion;

an image forming portion including a storage portion storing the developer and configured to form an image by using the developer stored in the storage portion; and a processor configured to execute:

a supply processing portion to supply the developer from the developer storage portion attached to the attachment portion to the storage portion when a storage amount of the developer stored in the storage portion is equal to or smaller than a predetermined first threshold;

a first release processing portion to release regulation on the removal of the developer storage portion imposed by the lock device when the storage amount of the developer stored in the storage portion is equal to or smaller than a second threshold that is smaller than the first threshold;

an acquisition processing portion to acquire a remaining amount of the developer in the developer storage portion attached to the attachment portion when the storage amount of the developer stored in the storage portion is larger than the second threshold; and a second release processing portion to release the regulation on the removal of the developer storage portion imposed by the lock device, based on the remaining amount of the developer acquired by the acquisition processing portion, wherein the second release processing portion releases the regulation on the removal of the developer storage portion imposed by the lock device when the remaining amount of the developer acquired by the acquisition processing portion is equal to or smaller than a predetermined first reference value in a case where a temperature in the image forming apparatus is equal to or higher than a predetermined reference temperature; and the second release processing portion releases the regulation on the removal of the developer storage portion imposed by the lock device when the remaining amount of the developer acquired by the acquisition processing portion is equal to or smaller than a second reference value that is greater than the first reference value in a case where the temperature in the image forming apparatus is lower than the reference temperature.

2. The image forming apparatus according to claim 1, wherein the processor is configured to execute:

a notification processing portion to, when the second release processing portion releases the regulation on the removal of the developer storage portion, notify a user that a timing to replace the developer storage portion has come in a case where the temperature in the image forming apparatus is equal to or higher than the reference temperature, and notify the user that fluidity of the developer in the developer storage portion has decreased in a case where the temperature in the image forming apparatus is lower than the reference temperature.

3. A regulation release method that is executed in an image forming apparatus that includes an attachment portion to which a developer storage portion storing developer is attached, a lock device configured to regulate removal of the developer storage portion attached to the attachment portion from the attachment portion, and an image forming portion including a storage portion storing the developer and configured to form an image by using the developer stored in the storage portion, the regulation release method comprising:

a supply step of supplying the developer from the developer storage portion attached to the attachment portion to the storage portion when a storage amount of the developer stored in the storage portion is equal to or smaller than a predetermined first threshold;

a first release step of releasing regulation on the removal of the developer storage portion imposed by the lock device when the storage amount of the developer stored in the storage portion is equal to or smaller than a second threshold that is smaller than the first threshold;

an acquisition step of acquiring a remaining amount of the developer in the developer storage portion attached to the attachment portion when the storage amount of the developer stored in the storage portion is larger than the second threshold; and a second release step of releasing the regulation on the removal of the developer storage portion imposed by the lock device, based on the remaining amount of the developer acquired in the acquisition step, wherein in the second release step, the regulation on the removal of the developer storage portion imposed by the lock device can be released when the remaining amount of the developer acquired by the acquisition step is equal to or smaller than a predetermined first reference value in a case where a temperature in the image forming apparatus is equal to or higher than a predetermined reference temperature; and the regulation on the removal of the developer storage portion imposed by the lock device can be released when the remaining amount of the developer acquired by the acquisition step is equal to or smaller than a second reference value that is greater than the first reference value in a case where the temperature in the image forming apparatus is lower than the reference temperature.

* * * * *